US007088296B2

(12) United States Patent
Gelman

(10) Patent No.: US 7,088,296 B2
(45) Date of Patent: Aug. 8, 2006

(54) CONTACT SYSTEM FOR AN ANTENNA STRUCTURE

(75) Inventor: Alexander Gelman, Fellbach (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/960,428

(22) Filed: Oct. 7, 2004

(65) Prior Publication Data

US 2005/0099346 A1 May 12, 2005

(30) Foreign Application Priority Data

Oct. 10, 2003 (DE) ..... 103 47 957
May 25, 2004 (DE) ..... 10 2004 025 619

(51) Int. Cl.
*H01Q 1/32* (2006.01)

(52) U.S. Cl. ..... 343/713; 343/711

(58) Field of Classification Search ..... 343/704, 343/713

See application file for complete search history.

(56) References Cited

U.S. PATENT DOCUMENTS

| | | | | |
|---|---|---|---|---|
| 3,945,014 | A * | 3/1976 | Kunert et al. | 343/713 |
| 4,707,591 | A | 11/1987 | Sprenger | 219/541 |
| 5,521,606 | A | 5/1996 | Iijima | 343/713 |
| 6,025,806 | A * | 2/2000 | Deininger et al. | 343/713 |
| 6,638,075 | B1 * | 10/2003 | Spaulding et al. | 439/34 |
| 6,825,812 | B1 * | 11/2004 | Yokota et al. | 343/713 |
| 6,903,698 | B1 * | 6/2005 | Silva | 343/713 |
| 2003/0176095 | A1 | 9/2003 | Feder | 343/713 |

FOREIGN PATENT DOCUMENTS

| | | |
|---|---|---|
| DE | 100 30 066 | 12/2001 |
| DE | 202 10 286 | 1/2003 |
| EP | 1 109 248 | 6/2001 |

* cited by examiner

*Primary Examiner*—Tho Phan
(74) *Attorney, Agent, or Firm*—Andrew Wilford

(57) ABSTRACT

An adapter between an antenna amplifier and an antenna conductor structure can have a spring biased slider bearing against a flexible strip conductor to press it against the contacts of the antenna conductor structure of a vehicle window.

17 Claims, 2 Drawing Sheets

CONTACT SYSTEM FOR AN ANTENNA STRUCTURE

FIELD OF THE INVENTION

The present invention relates to the electrical connection between a signal processing unit, for example, an antenna amplifier, and an antenna structure which is provided upon a part of a vehicle body, especially a vehicle window.

BACKGROUND OF THE INVENTION

DE 196 05 999 discloses a contact arrangement by means of which an electrical contact can be made with a flat antenna conductor structure on, for example, a window of the vehicle. Below a part of the vehicle body, a signal processing unit, for example, an antenna amplifier can be mounted by appropriate fastening means. The housing of this unit can have a support, usually an outrigger, at the end of which contacts are provided which are engageable with contact pads of an antenna conductor structure on a window. These contacts are connected, in turn, by conductors in or on the rigid support, with the signal processing unit. Utilizing this contact arrangement, an electrical connection can be made between the signal processor and the antenna conductor structure.

Utilizing the support, it is possible to connect the antenna conductor structure with the signal processing unit across a certain distance. Depending upon the nature of the vehicle body, the antenna amplifier and the antenna conductor structure, the contact arrangement may require significant tolerances range to insure that the contacts of the goal processor will meet the contact surfaces of the antenna conductor structure. It is also a drawback of this construction that the entire signal processing unit with the carrier and the contacts on the carrier must be completely replaced when they are damaged for example in the case of a crash of the vehicle. This need to replace the entire arrangement leads to significantly higher cost, especially since the signal processing unit, as a rule, is located between a portion of the body and the roof of the vehicle and thus may not be readily accessible.

OBJECTS OF THE INVENTION

It is, therefore, the principal object of the present invention to provide an improved electrical connection assembly between a signal processing unit and an antenna conductor structure on or in a portion of a vehicle, especially on or in a vehicle window, which is easily mounted, can bridge wide tolerances and, in the case of damage, is easily replaceable.

Another object of the invention is to provide an antenna assembly for an automotive vehicle which is of simple construction and is less costly to replace or repair in the case of damage.

SUMMARY OF THE INVENTION

These objects and others which will become apparent hereinafter are attained, in accordance with the invention with an antenna assembly for an automotive vehicle which comprises:

an antenna conductor structure on a window of a body of the automotive processor mounted on the body for processing antenna signals; and an adapter mounted on the vehicle body separate from the signal processor and electrically connecting the antenna conductor structure with the signal processor, the adapter having at least one flexible conductor electrically contacting the antenna conductor structure and making an electrical connection with the signal processor.

The antenna assembly thus can have a flexible conductor having at least one conductive track which can be bare or free of insulation at a contact region at which the track contacts the antenna conductor structure. The flexible conductor can have the configuration of a strip conductor and the strip conductor may have a minimum of two conductive tracks.

A pressure element can be provided on the adapter for pressing the flexible conductor against the antenna conductor structure and the pressure element can be a slide movable in the adaptor and a spring element, for example, a coil spring, braced against the slide. The slide can be at least partially elastically deformable and received in a recess of the adaptor.

According to a feature of the invention, the flexible conductor can have one end detachably or nondetachably secured to the adapter or the antenna conductor structure and another end detachable or nondetachable on the unit or in interface connected to the signal processor unit.

The flexible conductor can be part of a circuit carrier of the signal processor, e.g. a printed circuit board.

A press element can bear upon the flexible conductor in a region proximal to the adaptor and tracks of the flexible conductor can be separated from one another or joined in a common carrier film where the flexible conductor is connected to the adapter.

The adaptor can have a fastening region in which it is mounted on the vehicle body or on a part of the signal processor.

According to the invention, therefore, the electrical connection between the signal processing unit, e.g. the antenna amplifier, and the antenna conductor structure is made by a flexible contact element (flexible conductor, flexible strip or so-called cape tape), all of which are intended to be included by the term flexible conductor. This has the advantage that a connector, for example, a plug connector need not be provided between the contact forming portions and the electrical forming conductor running to the signal processing unit and thus high contact resistances and connection problems can be avoided. In addition, the carrier can be provided with the contact means through at least one flexible conductor or strip conductor which can accommodate itself to any optional arrangement of locations on the vehicle body. The flexible conductor has the advantage or being of an extremely flat construction and thus that it can be accommodated readily in the vehicle and especially in the roof of the vehicle. It can bridge considerable tolerances as well. The signal processing unit itself can be optionally shaped or constructed even in the region of the adapter since the flexible conductor can be folded or otherwise positioned.

According to a feature of the invention, a pressure element bears upon the contact region of the flexible conductor to press the latter against the contact pads or location of the antenna conductor structure. The flexible conductor can have the usual construction of a strip or band conductor, i.e. a carrier layer of a nonconductive layer, especially a synthetic resin and one or more, for example parallel, electrical conductive tracks which can be especially of copper, e.g. copper filaments which can be braided or woven or copper foil strips. To avoid oxidation of the copper fo the strip conductor and also to avoid electrical short circuiting between the conductive tracks and between a conductive track and any adjacent conductive element, the conductive tracks may be covered by a cover layer which also is composed of electrically insulated material and in the preferred case can be the same material as forms the support layer. At the locations of contact with the antenna conductor structure, the conductive tracks are freed from their insulating cover layers over the length of the contact regions. To ensure reliability of contact and to enable the system to bridge mounting and fabricating tolerances, the pressure element is provided to press the contact regions of the tracks against the contact pads of the antenna conductor structure. Since the pressure is maintained permanently, the contact remains reliable over the life of the device. A single pressure element can be used for two or more tracks.

As has been noted, it is advantageous to anchor one end of the flexible conductor to the adapter and to allow the flexible conductor, from this anchored end to drape over the pressure element and otherwise be free of connection to the adapter to its end connected to the signal processor unit. A pressing element can act against the draped portion of the flexible conductor. At the interface of the signal processor, a plug connection can be provided for the flexible conductor.

It also has been noted that the flexible conductor can be part of a circuit carrier, e.g. A printed circuit board, fo the signal processing unit. The adapter can have a fastening region at which it is mountable on a part of the vehicle or on the signal processing unit and can have a part enabling movement between the part of the vehicle on which it is mounted on the signal processing unit to allow tolerance compensation. Thus while fabrication and mounting tolerances do not normally allow exact positioning of contacts, with the invention, the aforementioned mobility can ensure a precise and reliable positioning of the contact locations. Once the necessary movements to compensate for tolerances are made, the adapter can be fixed in place so that the contact locations with respect to the mounting point is fixed and a reliable contact is ensured over the life of the apparatus.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
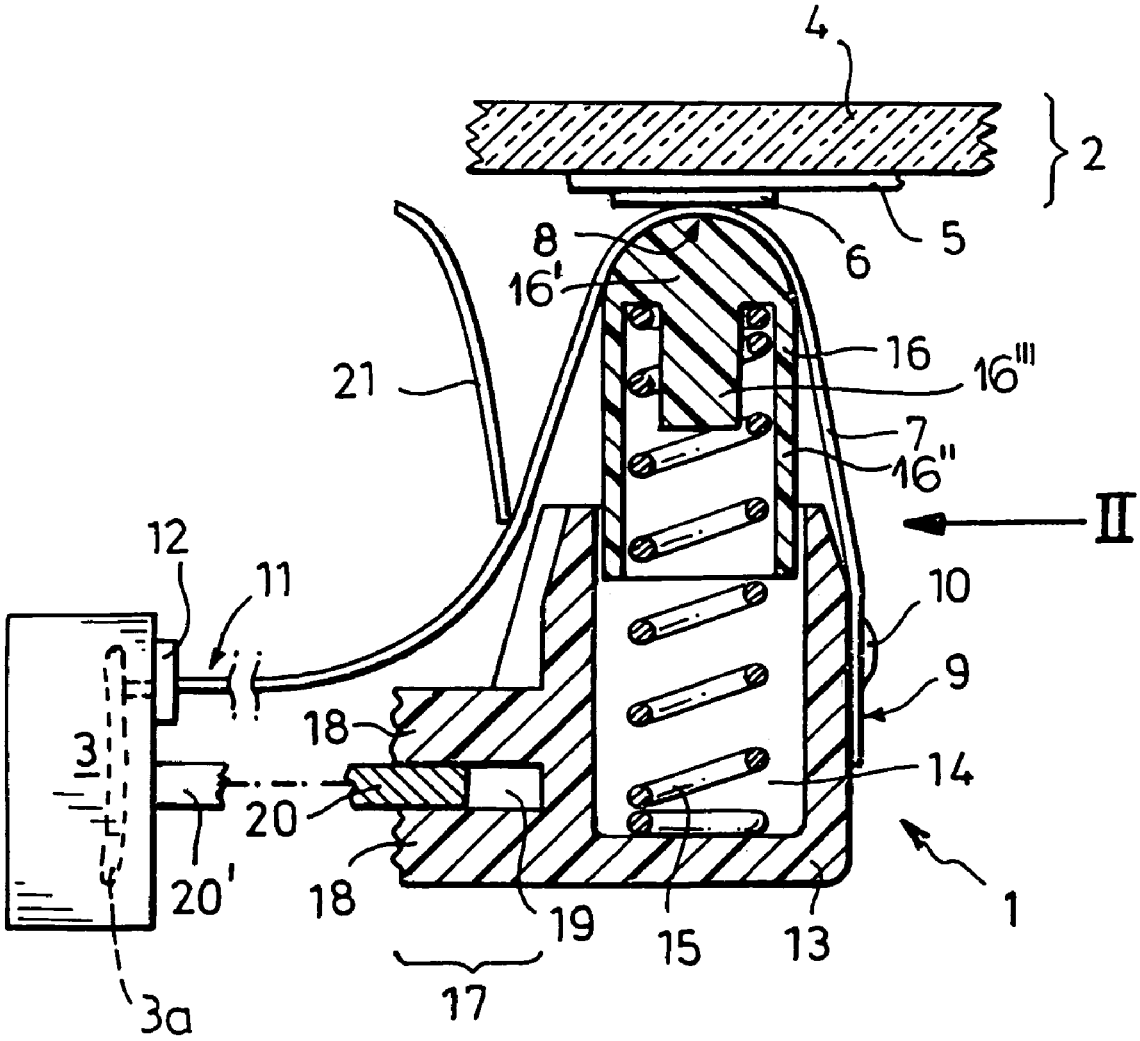
FIG. 1 is a cross sectional view showing the system of the invention.

The drawing shows an antenna assembly for an automotive vehicle and in particular the electrical connection with the signal processing unit 3, e.g. an antenna amplifier, and an antenna conductor structure 5 on a window 4 of an automotive vehicle which is indicated by its window antenna assembly 2 in FIG. 1.

To effect the contacting between that signal processing unit and antenna conductor structure, an adapter 1 is provided. More, particularly, the adapter 1 electrically connects a window antenna arrangement 2 of a vehicle with the signal processing unit 3, for example the antenna amplifier. The window antenna arrangement 2 has been shown only schematically and comprises the vehicle window 4 to which the antenna conductor structure 5 is applied. The antenna conductor structure 5 may have a plurality of contact pads 6 which can correspond in number of electrical conductors or tracks provided by the adapter 1. The device can also be used for other kinds of electrical contact and need not necessarily make contact with a conductor array on a vehicle window although it generally will be used for contacting a structure which can be either flat or three dimensional. The electrical connection and tolerance bridging is effected by a flexible conductor 7 which can have the aforedescribed structure of cover layer, the conductive tracks and support layer. In a contact region in which the conductive tracks 7*a* and 7*b* are juxtaposed with the contact pads 6*a* and 6*b*, the track 7*a* and 7*b* are free from insulation. The strap conductor is anchored at its end 9 to the adapter 1 at a fastening point 10, e.g. by an adhesive, screw, pin or a preformed element of the adapter 1. The other end 11 of the flexible conductor 7 is draped over a pressure element and connected to the unit 3, e.g. in the region of an interface 12, via for example a plug connection therewith. The end 11, as a rule, will be detachably connected with the unit 3 although it can be joined directly to the printing circuit board 3*a* thereof by a soldering or the like. In the latter case the adapter 1 and the unit 3 can form a single module. This is also the case when the flexible conductor 7 forms a part of the circuit carrier of the signal processor 3, the circuit carrier being for example completely flexible or having rigid and flexible components.

Figure 2:
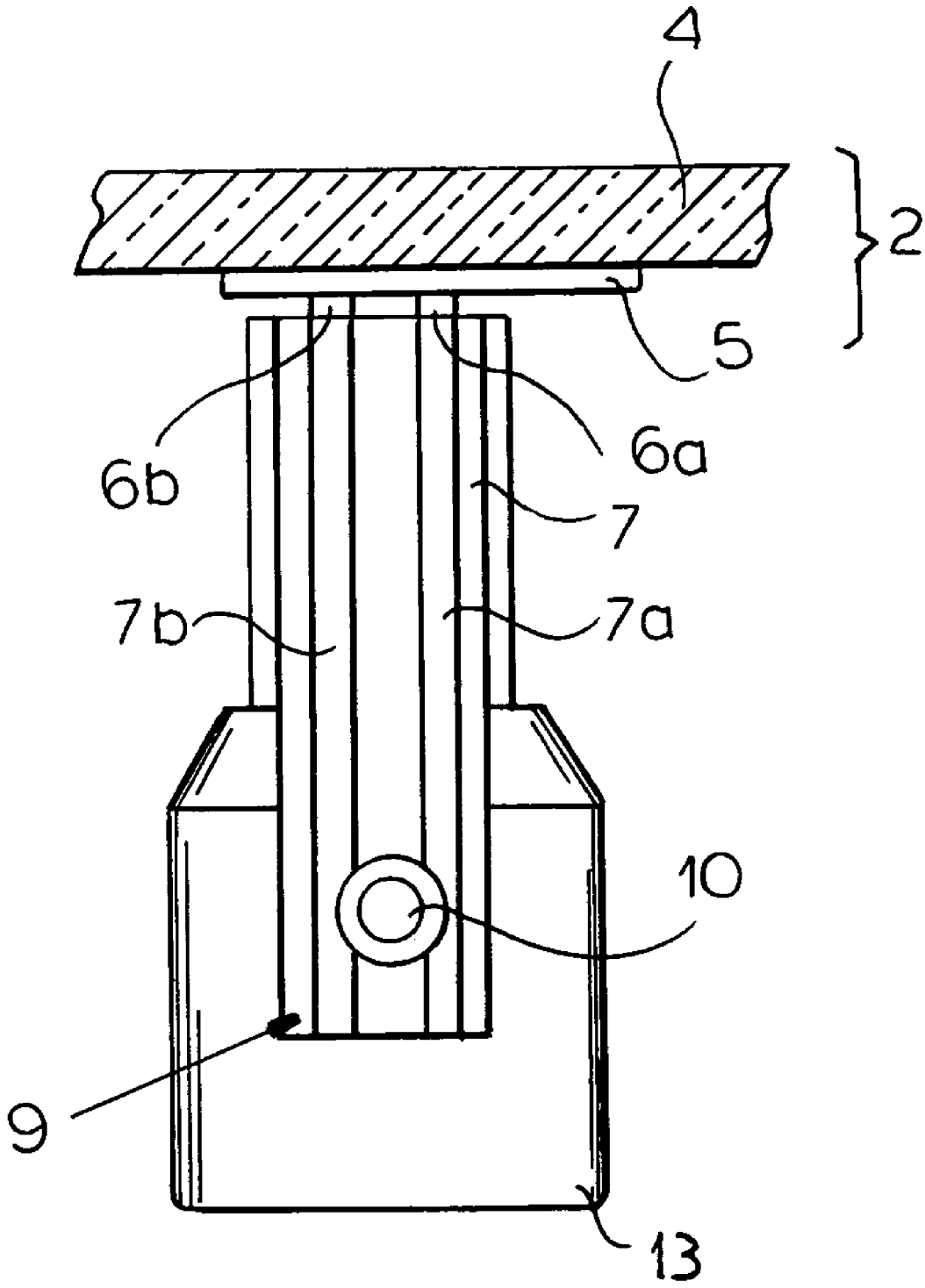
FIG. 2 is an elevational view taken in the direction fo the arrow II of FIG. 1.

The adapter 1 is comprised of a carrier 13 which can have the configuration illustrated in FIGS. 1 and 2 and is composed of an electrically nonconductive material. It can have a recess 14 in which a spring 15, for example a coil spring, is arranged. The coil spring is braced at one end against the carrier 13 and is provided on the other end with a slide 16 which forms the pressure element. The pressure element bears against the contact region 8 and presses the flexible conductor 7 in this region against the contact surfaces 6 of the antenna array 5. The slider 16 in the region 16' may itself be resilient so that the slider cannot be lost from the carrier 1 and can compensate for the mounting and fabrication tolerances. The slider 16 can have a rounded shape as shown and can have a sleeve portion 16" surrounding a boss 16'" to enable the spring 15 to be accommodated in the slider. The carrier 13 of the adapter can have a fastening region 17 with which the adapter 1 can be mounted on a part of the vehicle or on the signal processor 3. A detent arrangement can be provided to enable the adapter bo be shifted and locked in position. For example, the fastening region can be formed by two mutually parallel shanks 18 defining a seat 19 between them. A tongue 20, 20' of the housing 3 or a portion of the vehicle can engage in this slit and the adapter to be adjusted in position before it is anchored.

Each contact region 6 can be provided with a respective adapter so that a plurality of adapters can engage respective contact regions or a single adapter can be used for a number of contact regions. The strip conductor 7 may have more than two mutually parallel conductive tracks. A pressing element 21 (FIG. 1) may bear upon the slack portion of the flexible conductor to hold it taut as shown. Element 21 can be a tongue mounted on the support 13 or on a part of the vehicle or on the signal processing unit.

I claim:

1. An antenna assembly for an automotive vehicle, the assembly comprising:

an antenna conductor structure on a window of a body of the automotive vehicle;

a signal processor mounted on said body for processing antenna signals; and an adapter mounted on the vehicle body separate from said a signal processor and electrically connecting said antenna conductor structure with said signal processor, said adapter having at least one flexible conductor electrically contacting said antenna conductor structure and making an electrical connection with said signal processor, the conductor having at least one strip conductor track bare of insulation at a contact region at which the track contacts the antenna conductor structure; and means including a slide movable in the adapter and a spring element in the adapter braced against the slide for pressing the strip conductor against the antenna conductor structure.

2. The antenna assembly defined in claim 1 wherein said flexible conductor has at least two conductive tracks for simultaneous contacting of said antenna conductor structure.

3. The antenna assembly defined in claim 2 wherein tracks of said flexible conductor are separated from one another or joined in a common carrier film where the flexible conductor is connected to said adapter.

4. The antenna assembly defined in claim 1 wherein said slide is at least partly elastically deformable and is received in a recess of said adapter.

5. The antenna assembly defined in claim 1 wherein said flexible conductor has one end secured to said adapter or said antenna conductor structure and another end connected to said processor or an interface connected to said processor.

6. The antenna assembly defined in claim 1, wherein the flexible conductor is part of a circuit carrier of the signal processor.

7. The antenna assembly defined in claim 1 wherein said adapter has a fastening region at which said adapter is mounted on said vehicle body or on a part of the signal processor.

8. The antenna assembly defined in claim 7 wherein said fastening region is so shaped that a movement between the adapter and the part of the vehicle or signal processor on which the adapter is mounted is possible to compensate for tolerances and to allow mounting adjustments.

9. The antenna assembly defined in claim 1, further comprising a pressure element on said adapter for pressing said flexible conductor against said antenna conductor structure.

10. The antenna assembly defined in claim 1 wherein said flexible conductor has one end detachably or nondetachably secured to said adapter or said antenna conductor structure and another end detachably or nondetachably connected to said processor or an interface connected to said processor.

11. The antenna assembly defined in claim 1 wherein the flexible conductor is part of a circuit carrier of the signal processor.

12. The antenna assembly defined in claim 1 wherein said adapter has a fastening region at which said adapter is mounted on said vehicle body or on a part of the signal processor.

13. The antenna assembly defined in claim 12 wherein said fastening region is so shaped that a movement between the adapter and the part of the vehicle or signal processor on which the adapter is mounted is possible to compensate for tolerances and to allow mounting adjustments.

14. An antenna assembly for an automotive vehicle, the assembly comprising:

an antenna conductor structure on a window of a body of the automotive vehicle;

a signal processor mounted on the body for processing antenna signals; and an adapter mounted on the vehicle body separate from the signal processor and electrically connecting the antenna conductor structure with the signal processor, the adapter having at least one flexible conductor electrically contacting the antenna conductor structure and making an electrical connection with the signal processor, the conductor having at least one strip conductor track bare of insulation at a contact region at which the track contacts the antenna conductor structure, the adapter further having a fastening region at which the adapter is mounted on the vehicle body or on a part of the signal processor; and a pressure element on the adapter pressing the strip conductor against the antenna conductor structure, said fastening region being formed by two shanks defining a slit between them, a part of said vehicle body, or a printed circuit board of a signal processor being received in said slit.

15. The antenna assembly defined in claim 14 wherein said pressure element includes a slide movable in said adapter and a spring element in said adapter braced against said slide.

16. The antenna assembly defined in claim 14, further comprising a pressing element bearing upon said flexible conductor in a region proximal to said adapter.

17. The antenna assembly defined in claim 14, further comprising a pressing element bearing upon said flexible conducter in a region proximal to said adapter.

* * * * *